US007801455B2

(12) United States Patent
Solcz et al.

(10) Patent No.: US 7,801,455 B2
(45) Date of Patent: Sep. 21, 2010

(54) ARCHITECTURE FOR A MULTI TONER PRINTING SYSTEM

(75) Inventors: Edward John Solcz, Fairport, NY (US); Roger Derek Masham, Ashwell Herts (GB)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 11/962,968

(22) Filed: Dec. 21, 2007

(65) Prior Publication Data

US 2009/0162113 A1 Jun. 25, 2009

(51) Int. Cl.
*G03G 15/16* (2006.01)
*G03G 15/01* (2006.01)
*G03G 15/20* (2006.01)

(52) U.S. Cl. ..... 399/66; 399/302; 399/308; 399/317

(58) Field of Classification Search ..... 399/66, 399/297, 298, 299, 302, 308, 317
See application file for complete search history.

(56) References Cited

U.S. PATENT DOCUMENTS 5,337,136 A * 8/1994 Knapp et al. ..... 399/299
2003/0185601 A1* 10/2003 Toyohara et al. ..... 399/298
2006/0127139 A1* 6/2006 Ogata et al. ..... 399/299

* cited by examiner

*Primary Examiner*—David M Gray
*Assistant Examiner*—Joseph S Wong
(74) *Attorney, Agent, or Firm*—Oliff & Berridge, PLC

(57) ABSTRACT

A xerographic printing system and method of printing that includes two photoreceptor drums, each configured to enable printing with a different type of toner, a first pathway that connects the two photoreceptor drums, a second pathway that bypasses either of the photoreceptor drums, and an intermediate transfer belt, configured for either a one or two pass architecture, for transferring an image created by the toner to print media. This system and method of printing is specially adapted to enable efficient use of different combinations of toners within one printing system. In one embodiment, this system is able to limit use of a special toner to situations where one photoreceptor drum is not in bypass mode, thus conserving the more expensive special toner.

5 Claims, 4 Drawing Sheets

ARCHITECTURE FOR A MULTI TONER PRINTING SYSTEM

BACKGROUND

Currently, in the field of printing machines that use magnetic ink character recognition toner (MICR), MICR is only used on an infrequent basis to process financial documents that require the special characteristics of MICR toner. This is because the toner run costs for MICR are significantly higher than the run costs for conventional toner. Consequently, MICR machines generally remain idle for a considerable amount of time. The present embodiments relate to a printing system that would eliminate the need for a separate machine dedicated to only the one task of printing documents with MICR toner.

SUMMARY

This disclosure is generally directed to a printing system that incorporates distinct printing processes into a cohesive printing unit, such that efficiency and lower run time costs are achieved. The present disclosure incorporates a MICR printing system with a high run volume monochrome printing system. The system could also be configured to use another special toner other than MICR, or two or more combined special toners. The printing system may include an intermediate transfer belt configured for transferring an image to a print media in one rotation, a first image developing component wherein a first photoreceptor drum is configured for applying a first toner, in a first revolution of the first photoreceptor drum, to the intermediate transfer belt, a second image developing component wherein a second photoreceptor drum is configured for applying a second toner, in a first revolution of the second photoreceptor drum, to the intermediate transfer belt, a first intermediate transfer belt pathway that connects the first image developing component and the second image developing component, and a second intermediate transfer belt pathway that bypasses the second image developing component. In order to transfer a combined image, including the first toner from the first photoreceptor drum and the second toner from the second photoreceptor drum, to print media, the intermediate transfer belt may be configured to transfer the combined image to an image transferring means during a first rotation of the intermediate transfer belt.

The various embodiments may include use of different types of a first and second toner. A preferred embodiment includes a varied combination of monochrome toner or a magnetic ink character recognition toner. For example, in one embodiment, the first toner may be monochrome toner and the second toner may be magnetic ink character recognition toner. In a second embodiment, the first toner may be magnetic ink character recognition toner and the second toner may be monochrome toner.

In another embodiment, the printing system may include an intermediate transfer belt configured for transferring an image to print media in two rotations, a first image developing component wherein a first photoreceptor drum is configured for applying a first toner to the intermediate transfer belt, a second image developing component wherein a second photoreceptor drum is configured for applying a second toner to the intermediate transfer belt, a third image developing component wherein the first photoreceptor drum is configured for applying a third toner to the intermediate transfer belt and a fourth image developing component wherein the second photoreceptor drum is configured for applying a fourth toner to the intermediate transfer belt. This embodiment may require two rotations of the intermediate transfer belt and two revolutions of the first and second photoreceptor drums in order to transfer a combined image, including images formed from the first, second, third and fourth toners, to print media.

The printing system may also include an image transferring means that transfers the image on the intermediate transfer belt to the print media, which may include printing paper, financial documents such as checks, and the like. Furthermore, in order to accomplish a high quality transfer to print media the printing system may also include a fuser means that fuses the image to the print media. The fuser means could receive the print media from a pathway that connects the image transferring means to the fuser means.

In an exemplary embodiment, the printing system incorporates a method of printing including creating a combined image by transferring a first toner image to the intermediate transfer belt from the first photoreceptor drum, wherein a first image developing component is configured for applying a first toner, in a first revolution of the first photoreceptor drum, to the intermediate transfer belt. The method of printing further includes transferring a second toner image to the intermediate transfer belt from the second photoreceptor drum, wherein a second image developing component is configured for applying a second toner, in a first revolution of the second photoreceptor drum, to the intermediate transfer belt. Transferring the first and second toner images to the intermediate transfer belt creates a combined image, the combined image is then transferred to print media in a first rotation of the intermediate transfer belt.

EMBODIMENTS

This disclosure is not limited to the particular embodiments described herein, and some components and processes may be varied by one of ordinary skill in the art, based on this disclosure. The terminology used herein is for the purpose of describing particular embodiments, and is not intended to be limiting. Aspects of the exemplary embodiments, as disclosed, relate to a printing system that is capable of both monochrome and MICR printing and to a method of printing the same. Aspects of the exemplary embodiments, as disclosed, also relate to a printing system that is capable of producing images formed from various combinations of toners, including a combination of two, three or four different toners, and to a method of printing the same.

Figure 1:
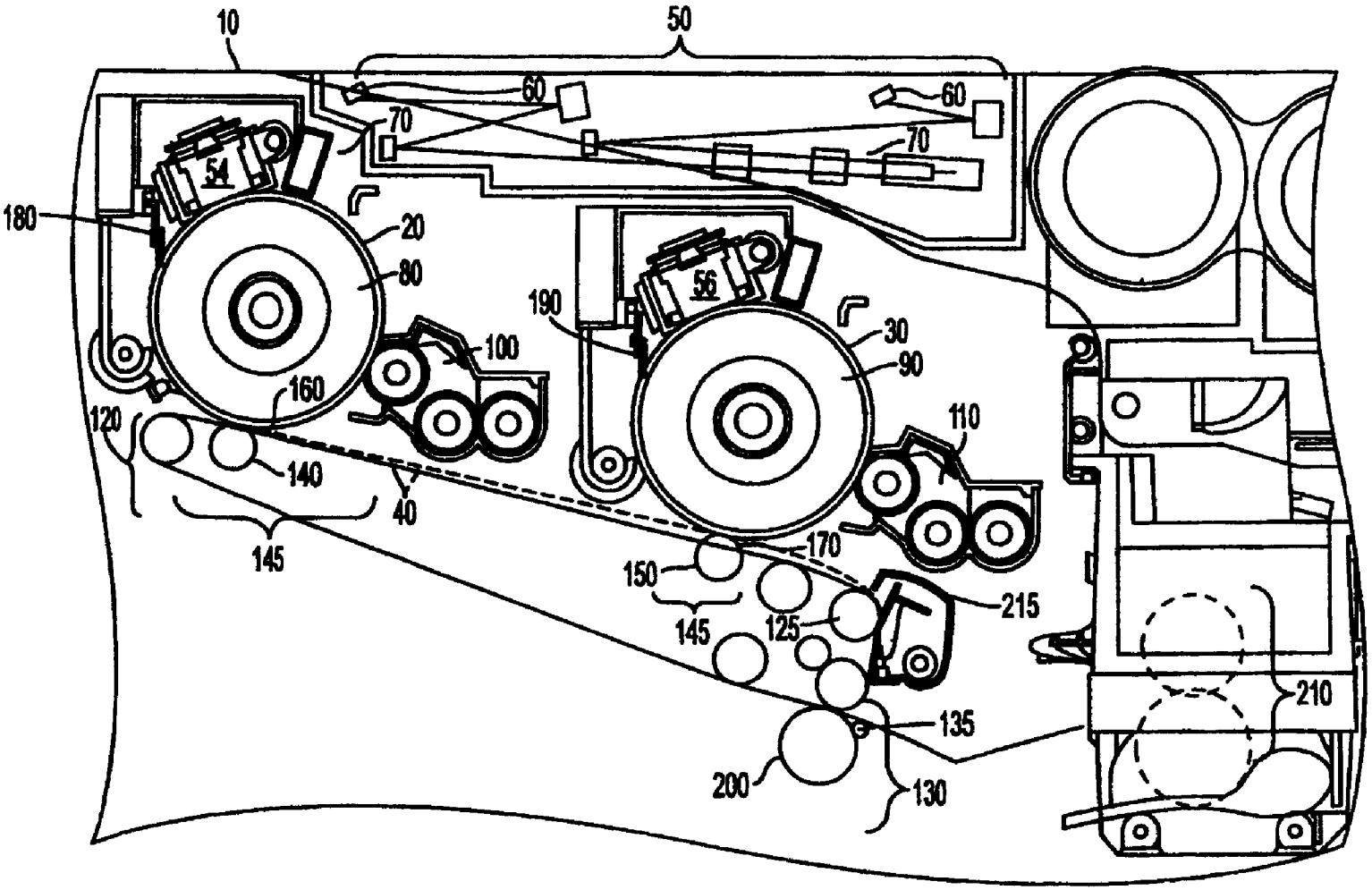
FIG. 1 is a schematic side view of a printing system according to a first embodiment.

The printing system 10, as shown in FIG. 1, includes two separate photoreceptor drums, a monochrome printing photoreceptor drum 20 and a MICR printing photoreceptor drum 30. The two photoreceptor drums 20 and 30 are connected by way of an intermediate transfer belt 40, which enables transfer of a combined image formed from different types of toner to print media The printing system 10 incorporates a raster output scanning system 50, which uses a laser or like device that serves as a photon source 60 to disperse a sheet of photons across a surface of the photoreceptor drums 20 and/or 30. The printing system 10 is configured in such a way that both photoreceptor drums 20 and 30 can be jointly used or only one photoreceptor drum is used for certain printing tasks. Moreover, the raster output scanning system 50 is capable of creating a first toner image using photoreceptor drum 30 and a second toner image, not related to the first image, using photoreceptor drum 20.

In one embodiment of this disclosure, the applicable photoreceptor drums 20 and/or 30 are first charged to a uniform state by application of an electrostatic charge. Charge applying unit 54 applies an electrostatic charge to exterior surface 80 of photoreceptor drum 20. Charge applying unit 56 applies an electrostatic charge to exterior surface 90 of photoreceptor drum 30. After which, a stream of photons 70, by the photon source 60, is applied to an exterior surface 80 and/or 90 of the respective photoreceptor drums 20 and 30. The photon source 60 can be pulsed on and off such as to create a pattern on the surface of the photoreceptor drums 20 and/or 30. The stream of photons 70 work to discharge the electrostatic energy on the exterior surfaces 80 and/or 90 of photoreceptor drums 20 and/or 30. This results in distinct areas on the exterior surfaces 80 and/or 90 having a charged state and distinct areas on the exterior surfaces 80 and/or 90 not having a charged state. The pulsation of the photon source 60 and rotation of the photoreceptor drums 20 and/or 30 results in the creation of an image code on the exterior surfaces 80 and/or 90 of the photoreceptor drums 20 and/or 30.

While the photon source 60 is applying a stream of photons 70 to the exterior surfaces 80 and/or 90, the photoreceptor drums 20 and/or 30 are also rotating. The drums 20 and 30 rotate adjacent to developer housings 100 and 110, respectively. The developer housings 100 and 110 are integral to the process of applying toner to the charged surfaces of the exterior surfaces 80 and 90, respectively. In the first embodiment, as shown in FIG. 1, developer housing 100, associated with photoreceptor drum 20, can be adapted for use with, for example, monochrome toner, also known as K toner, to exterior surface 80. Developer housing 110, associated with photoreceptor drum 30, can be adapted to be used with, for example, magnetic ink character recognition toner, also known as MICR toner, to exterior surface 90.

In another embodiment, developer housing 100, associated with photoreceptor drum 20, can be adapted for use with magnetic ink character recognition toner, also known as MICR toner, to exterior surface 80. Therefore, developer housing 110, associated with photoreceptor drum 30, can be adapted for use with monochrome toner, also known as K toner, to exterior surface 90. In further embodiments, developer housings, 100 and 110, associated with photoreceptor drums 20 and 30, respectively, may be adapted so that both use K toner or MICR toner.

The exterior surfaces 80 and 90 of photoreceptor drums 20 and 30, respectively, are capable of transferring toner onto intermediate transfer belt 40. The intermediate transfer belt 40 extends between the two photoreceptor drums 20 and 30. The intermediate transfer belt 40 has an intermediate transfer belt moving means 120, which enables it to accept a toner image formed by toner transferred from the exterior surfaces 80 and/or 90 and deliver a final combined image to an image transferring means 130.

In one embodiment, as shown in FIG. 1, the moving means 120 of intermediate transfer belt 40, consists of a roller or a series of rollers that aid the movement of the intermediate transfer belt. FIG. 1 shows an embodiment of the intermediate transfer belt moving means 120 that includes a driving roller 125 that aids in the movement of intermediate transfer belt 40.

The intermediate transfer belt 40 and exterior surfaces 80 and 90 use a toner image transferring means 145 to transfer a toner image from the exterior surfaces 80 and 90 to the intermediate transfer belt 40. One means by which to accomplish the transfer is to apply electrostatic force to the intermediate transfer belt 40. The electrostatic force acts in combination with mechanical forces, such that toner is transferred to the intermediate transfer belt. An example of such an embodiment is to have an electrostatic force applying means below the intermediate transfer belt 40 at the location where the intermediate transfer belt 40 comes into direct contact with exterior surfaces 80 and 90. As shown in FIG. 1, this can be accomplished by transfer rollers 140 and 150, respectively.

Transfer rollers 140 and 150 can act to apply electrostatic force at contact regions 160 and 170, respectively. Specifically, contact region 160 is the area where intermediate transfer belt 40 comes into direct contact with exterior surface 80 of photoreceptor drum 20. At this contact region 160, a toner image formed from toner is transferred from the exterior surface 80 to the intermediate transfer belt 40. The transferring of the image is aided by the toner image transferring means, which in the embodiment shown in FIG. 1 includes the transfer roller 140. In one embodiment, transfer roller 140 directly applies electrostatic force to aid the transfer of the toner image.

Contact region 170 is the area where intermediate transfer belt 40 comes into direct contact with exterior surface 90 of photoreceptor drum 30. At this contact region 170, a toner image formed from toner is transferred from the exterior surface 90 to the intermediate transfer belt 40. The transferring of the image is aided by the toner image transferring means, which in the embodiment shown in FIG. 1 includes the transfer roller 150. In one embodiment, transfer roller 150 directly applies electrostatic force to aid the transfer of the toner image.

After the toner image, in the form of toner, has been transferred to the intermediate transfer belt 40, exterior surfaces 80 and 90 are cleaned such that residual toner that was not transferred to the intermediate transfer belt 40 is removed. This is accomplished by an exterior surface cleaning means. For example, a cleaning station that contacts, directly or indirectly, the exterior surface of a photoreceptor drum can act as an exterior surface cleaning means.

FIG. 1 shows a cleaning station 180 that acts as the exterior surface cleaning means for exterior surface 80 of photoreceptor drum 20. Moreover, in FIG. 1 cleaning station 190 acts as the exterior surface cleaning means for the exterior surface 90 of photoreceptor drum 30. FIG. 1 shows a blade cleaner type of cleaning station as an exterior surface cleaning means. Other types of exterior surface cleaning means may also be used.

After the exterior surfaces 80 and 90 have been cleaned, by cleaning stations 180 and 190 respectively, a new charge can be applied to each surface by charge applying units 54 and 56 such that the printing process can begin again. Specifically, after exterior surface 80 has been cleaned by cleaning station 180, exterior surface 80 is ready to receive a new charge such that a new image can be formed on the exterior surface. Therefore, at this point the raster output signal will start the process for creating a new latent image, to be formed from toner, on the exterior surfaces 80 and/or 90. Consequently, the photoreceptor drums 20 and 30, together with developer housings 100 and 110, are able to accomplish transfer of toner images from the exterior surfaces 80 and 90 to the intermediate transfer belt 40. Transfer of a first image, formed of toner, from the exterior surface 90 to the intermediate transfer belt 40 occurs within a first cycle of the photoreceptor drum 30. Furthermore, transfer of a second image, formed of toner, from the exterior surface 80 to the intermediate transfer belt 40 occurs within a first cycle of the photoreceptor drum 20. Moreover, the combined image, which includes the first toner image and the second toner image, is transferred to the image transferring means 130 during a first rotation of the intermediate transfer belt 40. Transfer of the combined image from the intermediate transfer belt 40 to a print media occurs at contact area 135. Specially, the printing system shown in FIG. 1 has a single-pass architecture.

In a single-pass architecture, a first revolution of a first photoreceptor drum would be required to transfer a first toner to an intermediate transfer belt. For example, as shown in FIG. 1, the first cycle of photoreceptor drum 30 could act to transfer a first toner image, formed of toner associated with developer housing 110, to the intermediate transfer belt 40. If the system is not set to bypass mode, a first cycle of a second photoreceptor drum would be required to transfer a second toner image, formed of toner, to the intermediate transfer belt. For example, as show in FIG. 1, the first cycle of photoreceptor drum 20 could act to transfer a second toner image, formed of toner associated with developer housing 100, to the intermediate transfer belt 40. Furthermore, in a single-pass architecture one rotation of the intermediate transfer belt 40 would be required to transfer the combined image, which can include the toner images formed from the first and second toners if the system is not set to bypass mode, to print media.

In reference to FIG. 1, the printing system has two or more options for forming a final image that is transferred to print media. In Option A, the intermediate transfer belt 40 has a first toner image that is superimposed with a second toner image. In Option B, the intermediate transfer belt 40 has one toner image because the system is set to bypass mode, such that the second toner image is not applied to the intermediate transfer belt 40.

FIG. 1 shows an embodiment of a printing system where photoreceptor drum 30 can be bypassed, such that the system is used for printing with only one type of toner, for example, monochrome (i.e. K) toner. Specifically, according to FIG. 1, if Option A were to be used, the intermediate transfer belt 40 would first receive a first toner image from the photoreceptor drum 30 that could be adapted to use a special toner, for example, magnetic ink character recognition toner (MICR) toner. This first toner image is applied to the intermediate transfer belt 40 at contact region 170. Then, by way of the intermediate transfer belt moving means 120, the first toner image formed on the intermediate transfer belt 40 would move to contact area 160. At contact area 160, of the photoreceptor drum 20, a second toner image is formed, preferably from a different type of toner, for example K toner. The second toner image may be superimposed on the area of the intermediate transfer belt 40 that includes the first toner image. Therefore, the printing system has the capability to produce one document including at least two different types of toner, for example, K toner and MICR toner. Thus, the first toner and the second toner images are combined to form a final combined image. The combined image can then be transferred to a single print media by image transferring means 130.

Further referencing FIG. 1, if Option B were to be used, then the photoreceptor drum 30, which applies MICR toner, may be bypassed, such that no combined image is formed. In bypass mode, according to the embodiment discussed above, the intermediate transfer belt 40 would only receive a toner image from photoreceptor drum 20 that uses K toner. Therefore, the toner image could then be transferred to a single print media by image transferring means 130. Note this is one embodiment of the bypass mode. The printing system could be arranged such that photoreceptor drum 20 is bypassed and only a toner image from photoreceptor drum 30 is applied to the intermediate transfer belt 40. Furthermore, the system could be configured such that photoreceptor drum 20 is configured to print with a first toner, such as, for example, MICR toner, and photoreceptor drum 30 is configured to print with a second toner, such as, for example, K toner. Moreover, the system could be configured such that one photoreceptor drum or both photoreceptor drums are associated with different types of special toners.

After the intermediate transfer belt 40 progresses beyond the photoreceptor drums, a final combined image is ready to be transferred to a print media. The printing system uses an image transferring means 130 to transfer the combined image from the intermediate transfer belt 40 to a print media. In one embodiment, as shown in FIG. 1, the image transferring means 130 uses a process similar to that used by the toner image transferring means 145 to transfer an image formed of toner from the exterior surfaces 80 and 90 to intermediate transfer belt 40. In this regard, the image transferring means can include a print media transfer roller 200 that applies electrostatic force, in a manner similar to the transfer rollers 140 and 150, to the intermediate transfer belt 40. The intermediate transfer belt 40 is than able to transfer a combined image to print media at contact area 135.

Once the final combined image has been transferred to a print media, the print media can also pass through a fuser assembly 210. The fuser assembly fuses the combined image transferred from the intermediate transfer belt 40 to the print media to create a permanent image. Sheets fused with the final toner image can be assembled to an output destination (not shown) such as a finisher. The print media source, printing system 10 and output destinations can all be interconnected by a print media conveyor system (not shown).

After the combined image has been transferred from the intermediate transfer belt 40 to print media, the intermediate transfer belt can be cleaned to remove residual toner. The cleaning process can utilize the intermediate transfer belt moving means 120 in combination with a cleaning station. For example, cleaning station 215, as shown in FIG. 1, is a blade cleaner type of cleaning station. In this arrangement, residual toner is cleaned from the intermediate transfer belt 40 prior to the belt returning to photoreceptor drum 30 to receive a first toner image.

Figure 2:
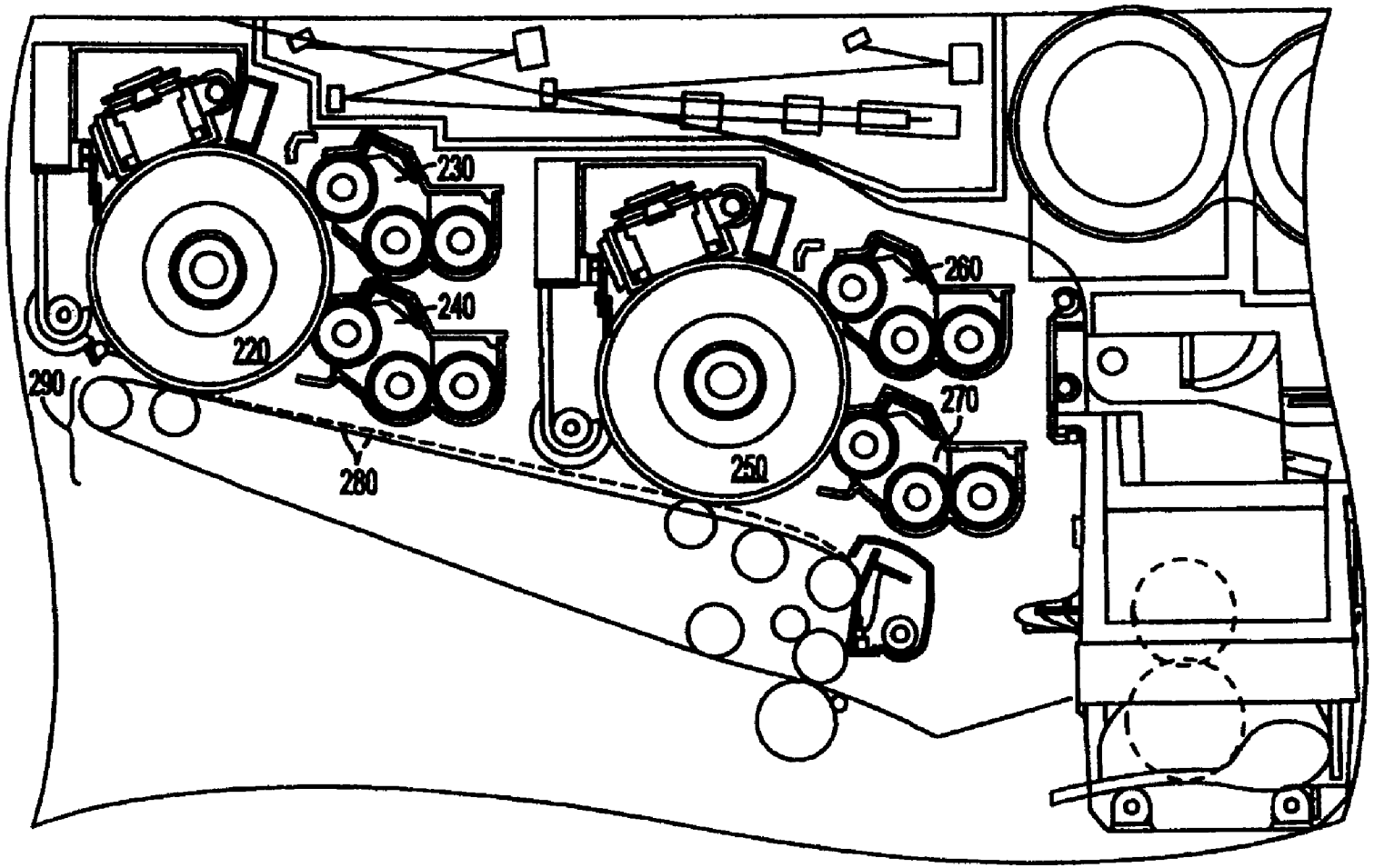
FIG. 2 is a schematic side view of a printing system according to a second embodiment.

The printing system could also be configured with a two-pass architecture, which would require a first and second cycle of the photoreceptor drums and two rotations of the intermediate transfer belt to create a final combined image. Specifically, a second embodiment with this type of two-pass architecture may include two separate developer housings to be associated with a single photoreceptor drum. As shown in FIG. 2, arranged around a photoreceptor drum 220 are developer housings 230 and 240. Furthermore, arranged around a photoreceptor drum 250 are developer housings 260 and 270. The photoreceptor drums are connected to each other by a two-pass intermediate transfer belt 280. Each developer housing can be configured to apply a different type of toner; for example, different colors such as cyan, magenta, yellow and black, or different types of toner, for example, K toner and MICR toner. The printing system can be arranged such that a varied combination of different types of toners can be used within the one printing system.

In a two-pass architecture, by way of the two-pass intermediate transfer belt 280, in a first cycle photoreceptor drum 220 may apply, using the same types of mechanisms and methods as discussed with the single-pass embodiment, to the two-pass intermediate transfer belt 280 a first toner associated with a first developer housing 230. In a second cycle, photoreceptor drum 220 may apply a second toner associated with a second developer housing 240. In another embodiment, the first toner could be associated with a first developer housing 240 and the second toner could be associated with a second developer housing 230. Furthermore, in a first cycle, photoreceptor drum 250 may apply a first toner associated with a third developer housing 260. In a second cycle, photoreceptor drum 250 would apply a second toner associated with a fourth developer housing 270. In another embodiment, the first toner would be associated with a third developer housing 270 and the second toner with a fourth developer housing 260.

As shown in FIG. 2, according to the embodiments discussed above, the two-pass system would require the intermediate transfer belt 280 to make two rotations. During a first rotation photoreceptor drum 250 could transfer a first toner image to the two-pass intermediate transfer belt 280. The first toner image could be formed from the toner in either developer housing 260 or 270. The intermediate transfer belt 280 would than move toward photoreceptor drum 220 to receive a second toner image. The second toner image could be transferred onto the intermediate transfer belt 280 on an area that overlaps the placement of the first toner image. Therefore, in the first pass, i.e. first rotation, of the intermediate transfer belt 280, a first and second toner image can be transferred to the belt 280. Note, as discussed above, the printing system can be set to bypass either of the photoreceptor drums such that either a first or second toner image is not transferred to the intermediate transfer belt 280.

During the first rotation of the intermediate transfer belt 280, two toner images can be transferred to the belt. Transferring of the third and fourth toner images requires a second pass, i.e. second rotation, of the intermediate transfer belt 280. Therefore, by way of intermediate transfer belt moving means 290 the intermediate transfer belt 280 can make a second rotation. During the second rotation, photoreceptor drum 250 can transfer a third toner image and photoreceptor drum 220 can transfer a fourth toner image. As discussed above, either developer housing 260 or 270 can supply the toner for the third toner image and either developer housing 230 or 240 can supply the toner for the fourth toner image. In an embodiment, if developer housing 260 supplies the toner for the first toner image, then developer housing 270 supplies the toner for the third toner image. In the alternative, if developer housing 270 supplies the toner for the first toner image, then developer housing 260 supplies the toner for the third toner image. Furthermore, if developer housing 230 supplies the toner for the second toner image, then developer housing 240 supplies the toner for the fourth toner image. In the alternative, if developer housing 240 supplies the toner for the second toner image, then developer housing 230 supplies the toner for the fourth toner image. Therefore, each developer housing, 230, 240, 260 and 270, may supply a different type of toner for at least one toner image when then the system is not set in a bypass mode.

In reference to the two-pass architecture, when the system is set in a bypass mode, the photoreceptor drum can be bypassed in both rotations of the intermediate transfer belt 280. The printing system can also be configured such that the photoreceptor drum is only bypassed in a first or second rotation of the intermediate transfer belt 280.

Another embodiment incorporates the essential features of a two-pass architecture and a single-pass architecture into one printing system and this embodiment would use the same mechanisms and methods of printing as previously discussed for the first and second embodiments. For example, a first photoreceptor drum may be configured like a two-pass system and a second photoreceptor drum may be configured like a single-pass system. With this, in a first cycle the first photoreceptor drum would apply a first toner to the intermediate transfer belt in a first rotation of the intermediate transfer belt and in a second cycle the first photoreceptor drum would apply a second toner to the intermediate transfer belt in a second rotation of the intermediate transfer belt. A second photoreceptor drum could apply a first toner to the intermediate transfer belt in a single revolution of the photoreceptor drum in either the first or second rotation of the intermediate transfer belt. Therefore, one photoreceptor drum could transfer a toner image in one rotation of the intermediate transfer belt and the other photoreceptor drum would require two rotations of the intermediate transfer belt. Moreover, this system would require an intermediate transfer belt moving means that enables two rotations of the intermediate transfer belt. However, during the first or second rotation the intermediate transfer belt could automatically bypass one of the photoreceptor drums. Furthermore, according to this embodiment, one photoreceptor drum could include two separate developer housing units, such that each would be capable of supplying a different type of toner. The other photoreceptor drum, which can be automatically bypassed in either a first or second rotation of the intermediate transfer belt, would include one developer housing unit that is capable of supplying one type toner. Preferably, each developer housing unit would supply a different type of toner to the printing system.

Figure 3:
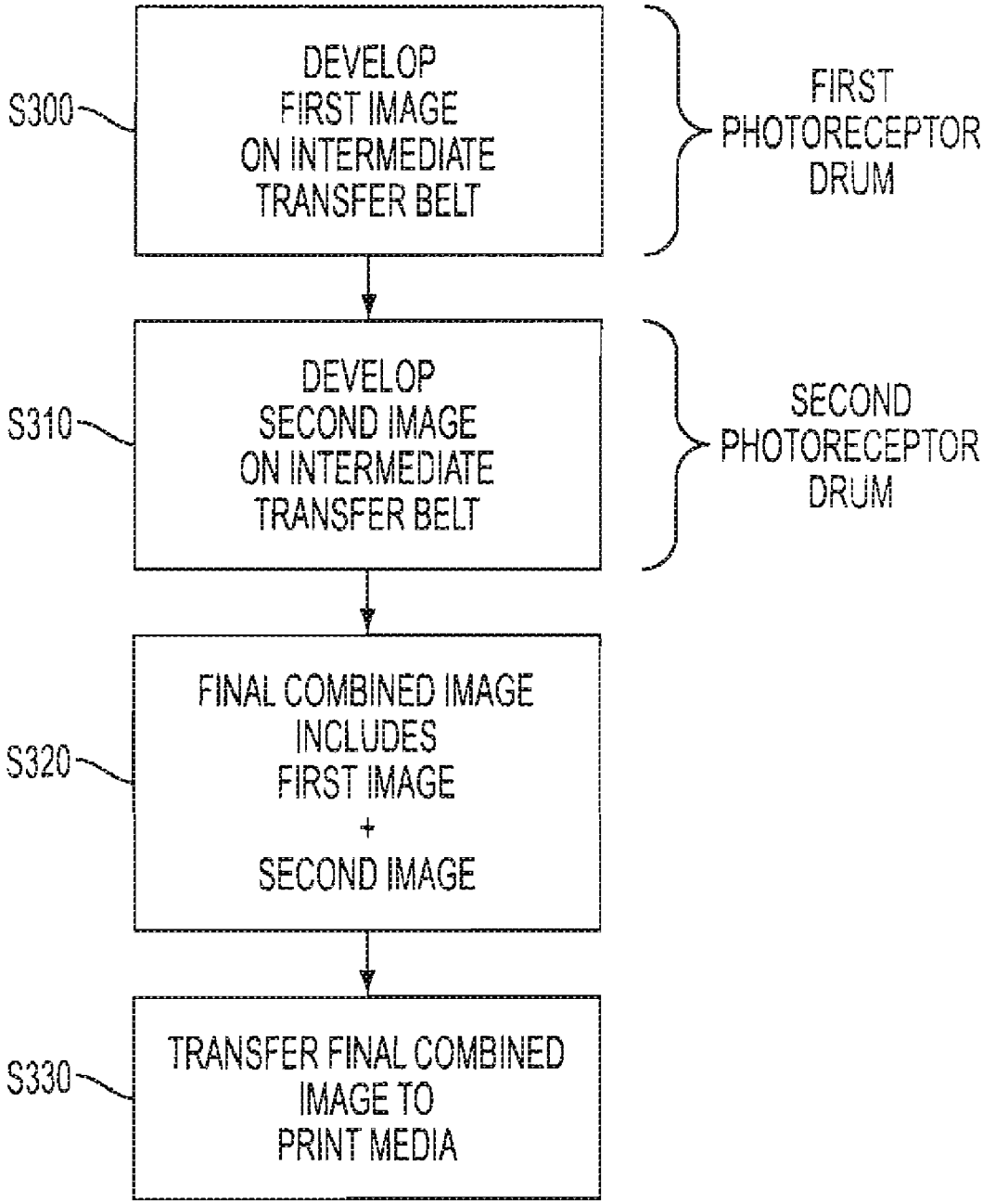
FIG. 3 is a method of printing according to a first embodiment.

In an embodiment including the two photoreceptor drums configured for single-pass architecture, a method of printing, as shown in FIG. 3, may include transferring a first toner image to an intermediate transfer belt, as shown in step S300. The transferring of the first toner image to the intermediate transfer belt may be achieved with a first photoreceptor drum. A first image developing component may be configured for applying a first toner, in a single revolution of the first photoreceptor drum, to the intermediate transfer belt during a first rotation of the intermediate transfer belt. Next, a second toner image may be transferred to the intermediate transfer belt, as shown in step S310, creating a combined image with a second photoreceptor drum. A second image developing component may be configured for applying a second toner, in a single revolution of the second photoreceptor drum, to the intermediate transfer belt during a first rotation of the intermediate transfer belt. Next, the combined image, as shown in step S320, formed on the intermediate transfer belt, may be transferred to print media, as shown in step S330.

Figure 4:
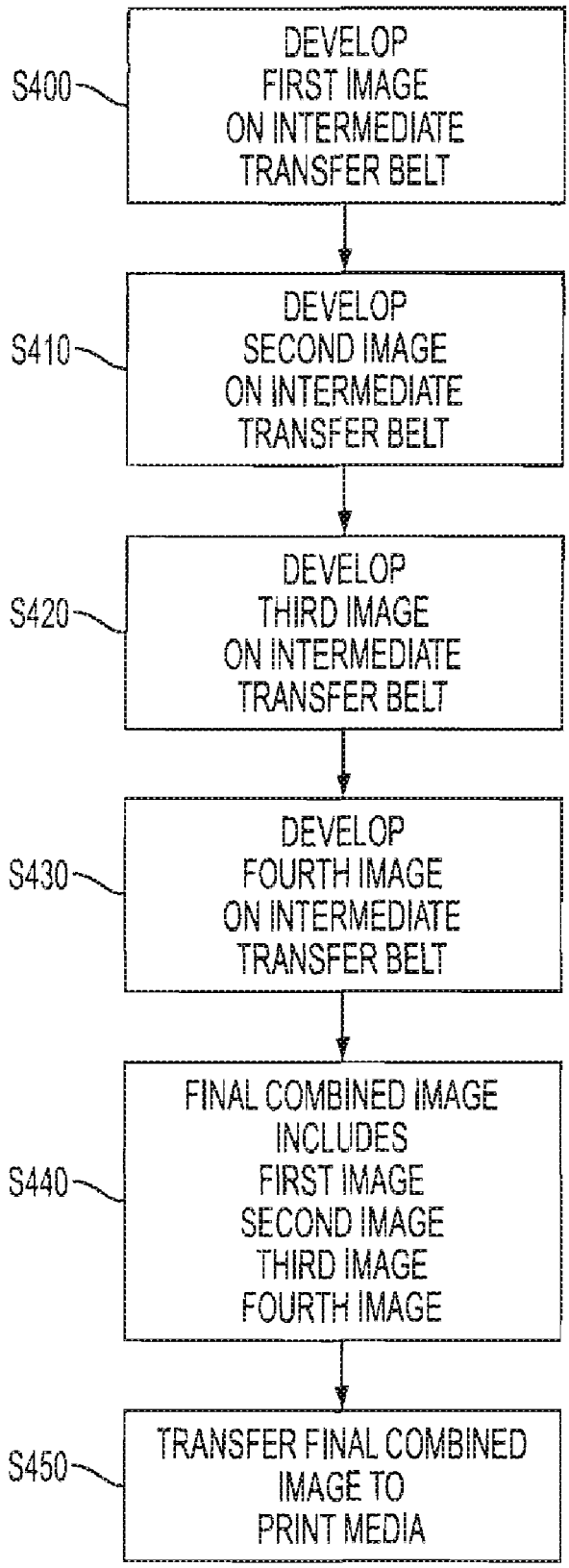
FIG. 4 is a method of printing according to a second embodiment.

In an embodiment including two photoreceptor drums in a two-pass architecture, a method of printing, as shown in FIG. 4, may include transferring a first image on an intermediate transfer belt, as shown in step S400, with a first photoreceptor drum. A first image developing component may be configured for applying a first toner in a first revolution of the first photoreceptor drum. A second image developing component may be configured for applying a second toner in a first revolution of the second image developing component to transfer a second toner image to the intermediate transfer belt, as shown in step S410. The first and second toner images may be transferred to the intermediate transfer belt during a first rotation of the intermediate transfer belt. Next, during a second rotation of the intermediate transfer belt, a third image may be transferred to the intermediate transfer belt, as shown in step S420, with the first photoreceptor drum. A third image developing component may be configured for applying a third toner in a second revolution of the first photoreceptor drum. During the second rotation of the intermediate transfer belt a fourth image may be transferred to the intermediate transfer belt, as shown in step S430, with the second photoreceptor drum. A fourth image developing component may be configured for applying a fourth toner in a second revolution of the second photoreceptor drum. The combined image, as shown in step S440, which includes the first, second, third and fourth toner images, formed of toner from the image developing components, formed on the intermediate transfer belt, may then be transferred to a print media, as shown in step S450.

In an embodiment including one photoreceptor drum in a single-pass architecture and one photoreceptor drum in a two-pass architecture, a method of printing may include two photoreceptor drums that are interconnected by an intermediate transfer belt. This method of printing may include a first photoreceptor drum, wherein a first image developing component may be configured for applying a first toner in a first revolution of the first photoreceptor drum; and a second photoreceptor drum, wherein a second image developing component may be configured for applying a second toner in a first revolution of the second photoreceptor drum. The first and second toners may be transferred to the intermediate transfer belt during a first rotation of the intermediate transfer belt. Next, a third image may be transferred to the intermediate transfer belt, wherein a third image developing component may be configured for applying a third toner in a second revolution of either the first or second photoreceptor drum. The combined image, which includes the first, second and third toner images, may be formed on the intermediate transfer belt and may then be transferred to a print media. This method of printing may also be configured such that a first toner is transferred during a first rotation of the intermediate transfer belt and the second and third toners are transferred during a second rotation of the intermediate transfer belt.

The printing system of any of the embodiments discussed above, may also have a bypass mode, such that one photoreceptor drum or developer housing could be bypassed. The bypass mode may enable the printing system to disengage one of the photoreceptor drums such that the intermediate transfer belt is taken out of contact with the photoreceptor drum. The photoreceptor drum can be disengaged from the intermediate transfer belt during a first and/or second rotation of the intermediate transfer belt. FIG. 1 illustrates one way to accomplish this bypass by using the aid of the image transfer roller 150 associated with photoreceptor drum 30. By using the bypass mode, the image transfer roller 150 may take the intermediate transfer belt 40 out of direct contact. As such, contact area 170 could be eliminated such that transfer of toner from the exterior surface 90 of photoreceptor drum 30 does not occur. In one embodiment of bypass configuration, photoreceptor drum 30 would not rotate so that undue wear and aging of the printing system component does not occur. Furthermore, this configuration would act to protect exterior surface 90 of photoreceptor drum 30 and conserve the toner associated with image developing component 110. The bypass mode is also possible with the second and third embodiments disclosed previously. Moreover, the printing system can be configured so that it is possible to bypass only the first photoreceptor drum or so that it is possible to bypass either of the photoreceptor drums. In such a system, the operator of the printing system could specify the type of toner that is required for a specific printing task before starting the printing task. This configuration would provide the operator a variety of options to best configure a specific print job to meet the requirements set forth for a specific document.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A monochrome xerographic printing system user switchable between magnetic ink character recognition (MICR), normal non-magnetic and combination monochrome modes, comprising:

an intermediate transfer belt configured for rendering an image to a print media;

a first photoreceptor drum having a first image developing component configured for applying a first non-magnetic monochrome toner, in a first image cycle of the first photoreceptor drum, to the intermediate transfer belt during a first rotation of the intermediate transfer belt;

a second photoreceptor drum having a second image developing component configured for applying a second MICR toner, in a first image cycle of the second photoreceptor drum, to the intermediate transfer belt during the first rotation of the intermediate transfer belt;

a user-selectable mode selection means for providing:

a first intermediate transfer belt pathway that contacts the first photoreceptor drum and the second photoreceptor drum to provide a composite image containing MICR toner and non-magnetic monochrome toner on the intermediate transfer belt in the combination monochrome mode;

a second intermediate transfer belt pathway that bypasses contact with the first photoreceptor drum to provide a single monochrome image of MICR toner on the intermediate transfer belt in the MICR mode; and a third intermediate transfer belt pathway that bypasses contact with the second photoreceptor drum to provide a single monochrome image of non-magnetic monochrome toner on the intermediate transfer belt in the normal non-magnetic mode.

2. The printing system of claim 1, further comprising an image transferring means for transferring the image on the intermediate transfer belt to the print media.

3. The printing system of claim 2, further comprising a fuser that fuses the image to the print media, the fuser receiving the print medium from a pathway connecting the image transferring means to the fuser.

4. A method of monochrome printing using magnetic ink character recognition (MICR) toner, non-magnetic toner, or a combination thereof in a monochrome printer, comprising:

providing a monochrome printer with an intermediate transfer belt, a first photoreceptor drum having a first image developing component for applying a first non-magnetic monochrome toner, in a first image cycle of the first photoreceptor drum, to the intermediate transfer belt in a first rotation of the intermediate transfer belt, and a second photoreceptor drum having a second image developing component for applying a second MICR toner, in the first image cycle of the second photoreceptor drum, to the intermediate transfer belt in the first rotation of the intermediate transfer belt;

selecting, by a user of the printer, type(s) of monochrome toner to be used by the monochrome printer;

selecting a mode of the printer based on the user selection from among a MICR mode, a normal non-magnetic mode and a combination monochrome mode;

configuring the intermediate transfer belt with an intermediate transfer belt pathway that (1) contacts both the first and second photoreceptor drums in the combination monochrome mode to transfer images from the first and second photoreceptor drums to the intermediate transfer belt, (2) contacts the first photoreceptor drum and bypasses contact with the second photoreceptor drum to transfer an image from the first photoreceptor drum to the intermediate transfer belt in the normal non-magnetic mode, and (3) contacts the second photoreceptor drum and bypasses contact with the first photoreceptor drum to transfer an image from the second photoreceptor drum to the intermediate transfer drum in the MICR mode; and transferring the image(s) on the intermediate transfer belt to a print media.

5. The method of printing of claim 4, further comprising fusing the image to the print media.

* * * * *